US010281903B2

(12) United States Patent
Zheng et al.

(10) Patent No.: US 10,281,903 B2
(45) Date of Patent: May 7, 2019

(54) PROCESS FOR DESIGN AND MANUFACTURE OF CAVITATION EROSION RESISTANT COMPONENTS

(71) Applicant: Hitachi, Ltd, Tokyo (JP)

(72) Inventors: Lili Zheng, Farmington Hills, MI (US); Wei Yuan, Farmington Hills, MI (US); Harsha Badarinarayan, Canton, MI (US)

(73) Assignee: Hitachi, Ltd., Tokyo (JP)

( * ) Notice: Subject to any disclaimer, the term of this patent is extended or adjusted under 35 U.S.C. 154(b) by 651 days.

(21) Appl. No.: 14/809,857

(22) Filed: Jul. 27, 2015

(65) Prior Publication Data

US 2017/0031351 A1 Feb. 2, 2017

(51) Int. Cl.
*C22F 1/04* (2006.01)
*G05B 19/4099* (2006.01)
(Continued)

(52) U.S. Cl.
CPC ..... *G05B 19/4099* (2013.01); *C21D 8/005* (2013.01); *C22C 1/00* (2013.01);
(Continued)

(58) Field of Classification Search
CPC .. B05D 5/00; C21D 8/005; C22C 1/00; C22F 1/04; C22F 1/04099; C22F 1/3513;
(Continued)

(56) References Cited

U.S. PATENT DOCUMENTS 4,588,440 A * 5/1986 Simoneau ..... C22C 38/30 148/325
4,751,046 A 6/1988 Simoneau
5,514,326 A 5/1996 Menon et al.
6,470,706 B1 * 10/2002 Engdahl ..... B01D 5/003 62/614

(Continued)

OTHER PUBLICATIONS

Caccese, V. , Light, K. H. and Berube, K.A.(2006) 'Cavitation erosion resistance of various material systems', Ships and Offshore Structures, 1 : 4, 309-322, maybe found at: http://www.tandfonline.com/doi/abs/10.1533/saos.2006.0136.*

(Continued)

*Primary Examiner* — Kenneth M Lo
*Assistant Examiner* — Mohammad A Rahman
(74) *Attorney, Agent, or Firm* — Mattingly & Malur, PC

(57) ABSTRACT

A process for designing and manufacturing a cavitation erosion resistant component. The process includes selecting a base material for use in a cavitation erosion susceptible environment and conducting a uniaxial loading test on a sample of the selected material. Thereafter, atomic force microscopy (AFM) topography on a surface of the tested sample is conducted and used to provide a surface strain analysis. The process also includes crystal plasticity finite element modeling (CPFEM) of uniaxial loading and CPFEM nanoindentation of the selected material over a range of values for at least one microstructure parameter. A subrange of microstructure parameter values that correlate to CPFEM nanoindentation results that provide increased CE resistance is determined. Finally, a component having an average microstructure parameter value that falls within the subrange of microstructure parameter values is manufactured.

20 Claims, 7 Drawing Sheets

(51) Int. Cl.

| | |
|---|---|
| ***C21D 8/00*** | (2006.01) |
| ***C22F 1/10*** | (2006.01) |
| ***C22F 1/06*** | (2006.01) |
| ***C22F 1/08*** | (2006.01) |
| ***C22F 1/18*** | (2006.01) |
| ***C22C 1/00*** | (2006.01) |

(52) U.S. Cl.
CPC ..... *C22F 1/04* (2013.01); *C22F 1/06* (2013.01); *C22F 1/08* (2013.01); *C22F 1/10* (2013.01); *C22F 1/183* (2013.01); *G05B 2219/35134* (2013.01); *G05B 2219/49007* (2013.01)

(58) Field of Classification Search
CPC ..... G05B 2219/06; G05B 2219/08; G05B 2219/10; G05B 2119/183; G05B 19/49007
See application file for complete search history.

(56) References Cited

U.S. PATENT DOCUMENTS

2008/0135750 A1* 6/2008 Kley ..... B82Y 35/00 250/306
2013/0252337 A1* 9/2013 Yang ..... C12M 23/12 435/395
2014/0261918 A1* 9/2014 Jin ..... C22C 38/38 148/620
2016/0018334 A1* 1/2016 Tomar ..... G01N 21/65 356/301

OTHER PUBLICATIONS

W.C. Oliver "Measurement of Hardness and Elastic Modulus by Insturmented Indentation: Advances in Understanding and Refinements to Methodology", Journal of Materials Research dated Sep. 23, 2003.

* cited by examiner

Fig-1a
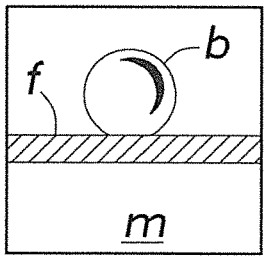
Fig-1b
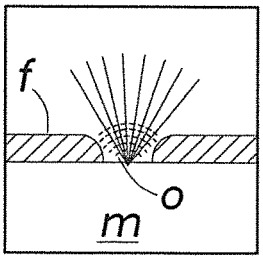
Fig-1c
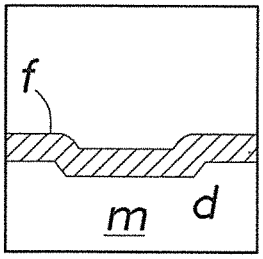
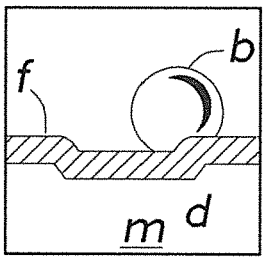
Fig-1d
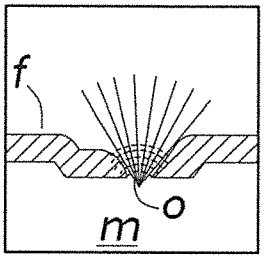
Fig-1e
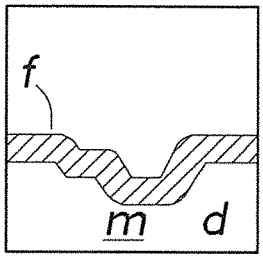
Fig-1f
Fig-2
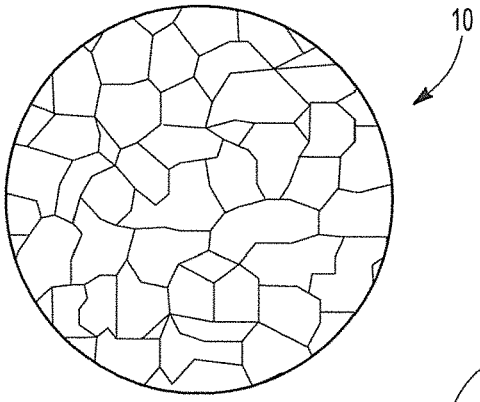
Fig-3
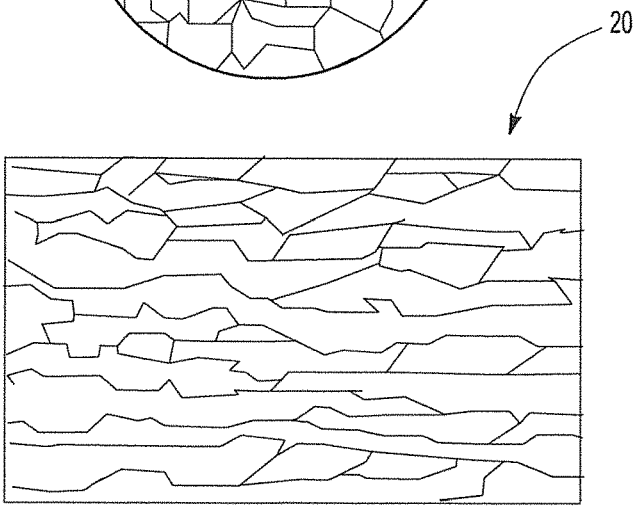

Fig-11
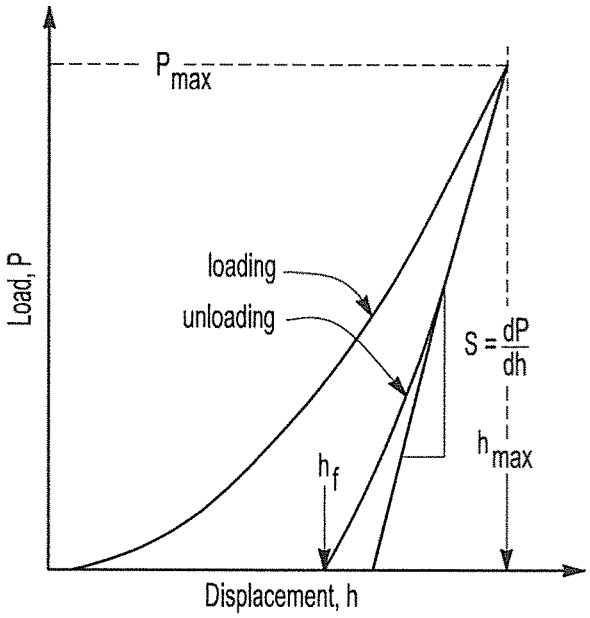
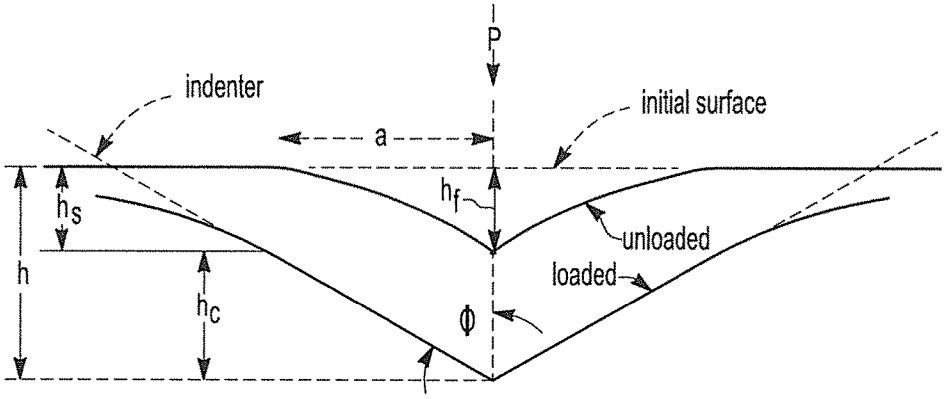
Fig-12
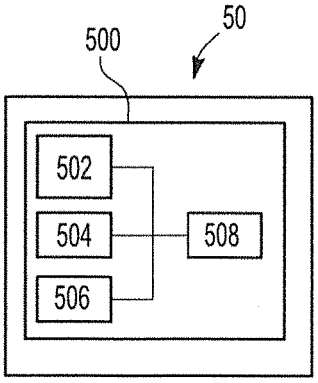
Fig-14

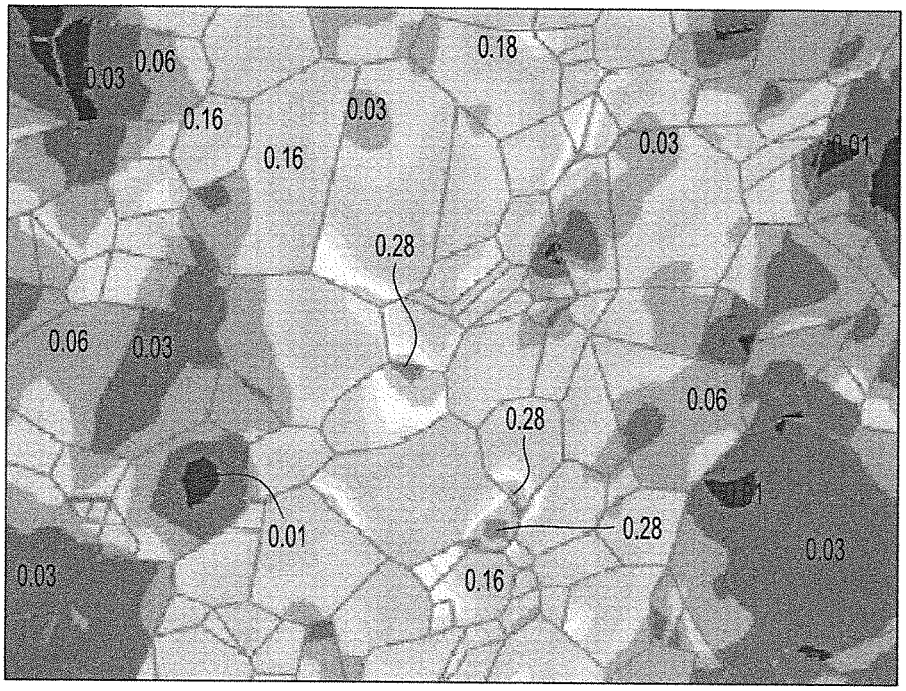
Fig-13a SIMULATION
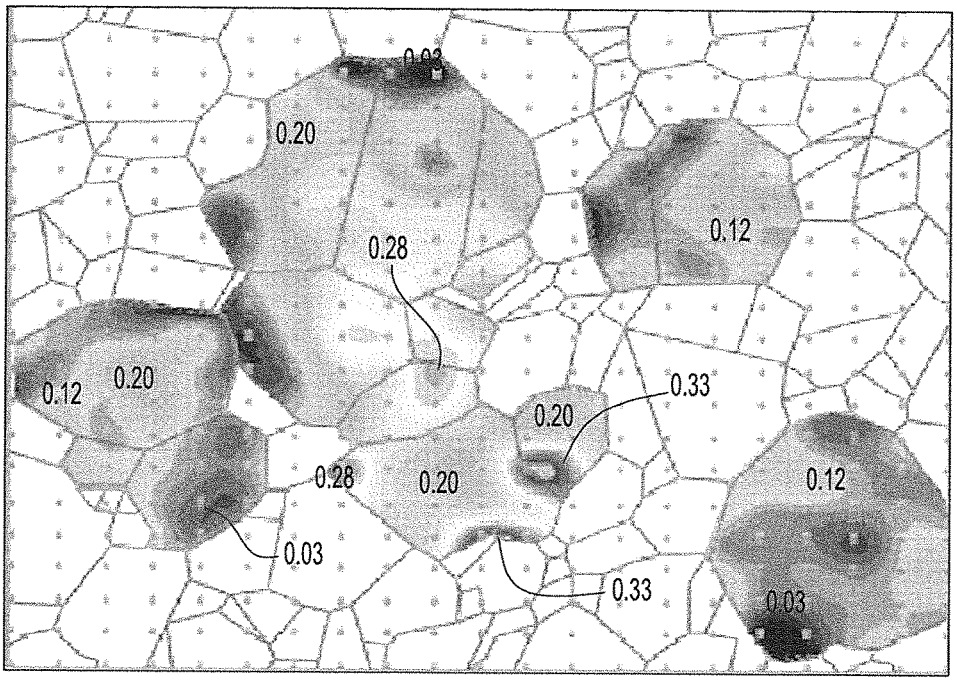
Fig-13b EXPERIMENT

PROCESS FOR DESIGN AND MANUFACTURE OF CAVITATION EROSION RESISTANT COMPONENTS

FIELD OF THE INVENTION

The present invention is directed to a process for designing and manufacturing a component that is resistant to cavitation erosion, and in particular to a process for designing and manufacturing a cavitation erosion resistant component using crystal plasticity finite element modeling.

BACKGROUND OF THE INVENTION

Cavitation erosion (CE) is caused by the formation and collapse of vapor bubbles in a liquid near a metallic component surface. For example, FIG. 1 provides a series of figures in which the cavitation erosion mechanism is shown. In FIG. 1*a*, a vapor bubble 'b' forms on an outer film 'f' that is present on a surface of a matrix material 'm'. Upon collapse of the vapor bubble b as illustrated in FIG. 1*b*, the film f experiences a local failure or opening 'o'. In addition, a small defect 'd' can be formed within the matrix material 'm' and the film 'f' may or may not form over the defect site as shown in FIG. 1*c*. The defect site 'd' can act as or is prone to the formation of additional vapor bubbles 'b' (FIG. 1*d*), which when the bubble 'b' collapses (FIG. 1*e*) produces another opening 'o' within the surface film 'f' and additional damage via defect site 'd' to the matrix material 'm' occurs (FIG. 1*f*). Once such a defect site 'd' is formed, pitting attack can also occur at such a location.

It is appreciated that CE can occur in equipment that processes, uses and/or is subjected to high pressure liquid. In addition, high pressure hydraulic pumps used in various industries, such as the automotive industry, have experienced a gradual increase in pressure requirements, and thus an increase in the susceptibility to CE. As such, there is an ever-increasing need for materials that provide improved CE resistance.

It is known from empirical studies, metallic materials with high hardness and low second phase precipitates have been found useful in CE susceptible environments. However, it is also known that the presence of second phase precipitates can enhance the hardness of a material and thus possibly provide increased CE resistance. However, in order to empirically determine whether or not which second phase precipitates can actually improve CE resistance, CE testing for each combination of metallic material with second phase precipitates would have to be conducted. The same is true for whether or not other microstructural features such as grain size, grain orientation, etc., can provide increased CE resistance. Yet such testing takes time and can be expensive. Therefore, a process for designing metallic materials for CE resistance which does not require empirical testing over a wide range of microstructural features would be desirable.

SUMMARY OF THE INVENTION

A process for designing and manufacturing a cavitation erosion (CE) resistant component is provided. The process includes selecting a base metallic material for use in a CE susceptible environment. In addition, the process includes conducting a uniaxial loading test on a sample of the selected material and then conducting atomic force microscopy (AFM) topography on a surface of the tested sample. The AFM topography provides a surface strain analysis of the surface of the tested sample.

The process also includes crystal plasticity finite element modeling (CPFEM) of uniaxial loading of an FEM sample for the selected material and using the CPFEM to obtain a surface strain characterization thereof. The AFM topography surface strain analysis is compared to the CPFEM surface strain characterization and a determination is made as to whether or not the comparison falls within a predetermined tolerance. In the event that the comparison does not fall within a predetermined tolerance, additional CPFEM is performed until the CPFEM surface strain characterization does agree with AFM topography surface strain analysis within the predetermined tolerance. In addition, optional neutron diffraction of the selected material during in situ uniaxial loading can be included in the process in order to provide lattice strain history and single crystal stiffness data on the selected material. Such additional data can be used in the CPFEM of uniaxial loading of the selected material in order to provide a more accurate surface strain characterization.

When the AFM topography surface strain analysis and the CPFEM surface strain characterization agree within the predetermined tolerance, the process conducts CPFEM of nanoindentation on an FEM sample of the selected material over a range of values for at least one microstructure parameter. The nanoindentation CPFEM over the range of values for the at least one microstructure parameter provides a plurality of hardness values, and possibly other material property values, as a function of the range of values for the at least one microstructural parameter. The plurality of hardness values are reviewed and a subset is selected which corresponds to improved CE resistance. In addition, a subrange of values for the at least one microstructure parameter that corresponds to the subset of hardness values is also selected. Once the subrange of values for the at least one microstructure parameter is selected and/or identified, the selected material is used to manufacture a component. In addition, the component has a microstructure with an average value of the at least one microstructure parameter that falls within the selected subrange of values.

The at least one microstructure parameter can be an average grain size, an average grain orientation, a presence of second phase precipitates, a type of second phase precipitate, an average size of a plurality of second phase precipitates, an average shape of a plurality of second phase precipitates, and an average particle number density of a plurality of second phase precipitates. In some instances, the nanoindentation CPFEM is performed over a range or iteration of at least two microstructure parameters, and optionally over a range of at least three microstructure parameters. In this manner, basic mechanical property data for a selected material is generated using a uniaxial loading test and AFM topography analysis, and such property data is used in CPFEM nanoindentation in order to obtain an optimum microstructure with respect to CE resistance. Furthermore, and as noted above, neutron diffraction of the selected material can be used to provide data in the CPFEM.

BRIEF DESCRIPTION OF THE DRAWINGS

FIG. 1*a* is a schematic illustration demonstrating the formation of a vapor bubble on a surface of a component as part of the cavitation erosion (CE) process;

FIG. 1*b* is a schematic illustration demonstrating the bursting the vapor bubble shown in FIG. 1*a* on the surface of the component as part of the CE process;

FIG. 1*c* is a schematic illustration demonstrating the formation of a defect site the surface of the component shown in FIG. 1*a* as part of the CE process;

FIG. 1*d* is a schematic illustration demonstrating the formation of another vapor bubble on the surface of the component at the defect site shown in FIG. 1*c* as part of the CE process;

FIG. 1*e* is a schematic illustration demonstrating the bursting the vapor bubble shown in FIG. 1*d* on the surface of the component as part of the CE process;

FIG. 1*f* is a schematic illustration demonstrating the deepening of the defect site shown in FIG. 1*d* as part of the CE process;

FIG. 2 is a schematic illustration of a microstructure for a selected material having equiax grains;

FIG. 3 is a schematic illustration of a microstructure for a selected material having textured grains;

FIG. 11 is a schematic illustration of indentation load versus displacement obtained through nanoindentation;

FIG. 12 is a schematic illustration of the unloading process during nanoindentation with parameters that characterize a contact geometry;

FIG. 13*a* is strain map for cumulative shear strains $\Sigma_\alpha \gamma^\alpha$ over all slip systems calculated by CPFEM simulations;

FIG. 13*b* is strain map for cumulative shear strains $\Sigma_\alpha \gamma^\alpha$ over all slip systems obtained using an AFM topography analysis using 400 (20×20) analysis points; and FIG. 14 is a schematic illustration of a computer for conducting various steps of the process disclosed herein.

DETAILED DESCRIPTION OF THE INVENTION

Figure 4A:
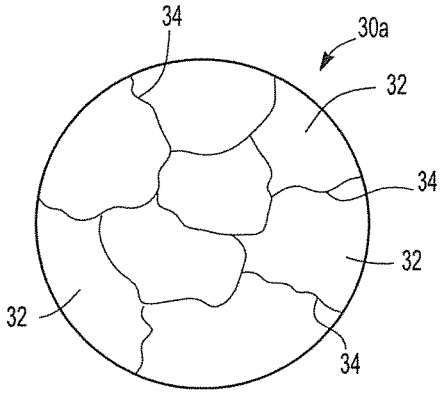
FIG. 4*a* is a schematic illustration of a microstructure for a selected material having equiax grains with no second phase precipitates present.

A process for designing and manufacturing a cavitation erosion (CE) resistant component is provided. The process provides a substantial improvement for material design related to cavitation erosion resistance and reduces time and cost related to the design and manufacture of anti-cavitation erosion equipment such as high pressure pumps.

The process can include determining operation conditions in a given industrial application that is susceptible to cavitation erosion. Such operation conditions can include a given liquid environment, pressure of the liquid environment, possible flow rate of the liquid environment, and the like. The process also includes selecting a material that may or may not be used in the liquid environment, such materials typically including steels, stainless steels, nickel alloys, aluminum alloys, titanium alloys, copper alloys, and the like. Once a given material or alloy is selected, a sample of the selected material, e.g. a tensile sample, is subjected to uniaxial loading such that the surface of the sample is subjected to surface strain. For example, 3-7% total strain is reached in order to provide clear slip traces but not excessive grain deformation. Thereafter, atomic force microscopy (AFM) topography of the surface of the tested sample is conducted and a surface strain analysis of the surface is produced using the results from the AFM topography.

Computer modeling of uniaxial loading of the selected material is performed and a surface strain characterization from the computer modeled uniaxial loading is produced. In some instances, the computer modeling is crystal plasticity finite element modeling (CPFEM) as is known to those skilled in the art. It is appreciated that the CPFEM includes a finite element model (FEM) of a uniaxial loading test sample, e.g. a tensile sample.

After the surface strain characterization produced by the CPFEM of the uniaxial loading of the selected material has been produced, it is compared with the AFM topography surface strain analysis produced from the actual uniaxial loading test on the selected material sample. In the event that the comparison falls within a predetermined tolerance, i.e. there is a desired agreement between the AFM topography surface strain analysis and the CPFEM surface strain characterization, CPFEM of nanoindentation of the selected material is executed. It is appreciated that the predetermined tolerance is a difference between the two techniques of less than or equal to 10%.

The CPFEM nanoindentation is conducted over a range of microstructure parameter values for the selected material. Stated differently, a single CPFEM nanoindentation is executed for a single microstructure parameter value that is within a range of predetermined and selected microstructure parameter values. As such, a plurality of CPFEM nanoindentation simulations are conducted for a plurality of microstructure parameter values. For example and for illustrative purposes only, a CPFEM nanoindentation of the selected material is executed for the material having an average grain size of 10 microns, then another CPFEM nanoindentation is executed for an average grain size of 15 microns, and the like until an entire range of average grain sizes are investigated or simulated with respect to the CPFEM nanoindentation.

A range of mechanical property data for the selected material is obtained as a function of the range of microstructure parameter values from the plurality of CPFEM nanoindentation simulations. In some instances, the range of mechanical property data is a plurality of hardness values, ductility values, etc., that are obtained as a function of the range of microstructure parameter values.

A subset of the mechanical property data is selected, along with a corresponding subrange of microstructure parameter values that produce the subset of mechanical property data. It is appreciated that the subset of mechanical property data can represent or be correlated with improved CE resistance and thus the corresponding subrange of microstructure parameter values provides a desired microstructure for the selected material that is CE resistant.

Once the subrange of microstructure parameter values has been selected, a component is manufactured from the selected material and the component has a microstructure that is characteristic of the subrange of microstructure parameter values. Stated differently, the microstructure of the component made from the selected material has an average microstructure parameter, e.g. an average grain size, that is within the selected and corresponding subrange of the microstructure parameter values. As such, the manufactured component has an improved CE resistance compared to a similar or identical component made from the same selected material but having a microstructure that falls outside the selected and corresponding subrange of microstructure parameter values.

In some instances, neutron diffraction is conducted during in situ uniaxial loading of an actual material sample from the selected material and the neutron diffraction allows for single crystal stiffness data on the selected material to be obtained. In addition, the single crystal stiffness data obtained via the neutron diffraction can be used in the CPFEM of the uniaxial loading and/or nanoindentation simulations.

Given the above, it is appreciated that micromechanical modeling and nanoindentation test modeling combined therewith provide a process for optimized material design and component fabrication for CE environments.

It is appreciated that CE can be reduced through equipment design, through the use of more erosion-resistant materials, and the like. In addition, increasing a material's hardness can increase its cavitation erosion resistance; however, a decrease in fabricability can be associated with such increase in hardness. Therefore, the instant disclosure provides a process for optimizing a selected material's microstructure in order to enhance the material's cavitation erosion resistance.

Looking now at FIGS. 2-4, a series of illustrative microstructures for a selected material are shown. For example, FIG. 2 shows an equiax grain structure at reference numeral 10 for a selected material. It is appreciated that such an equiax structure can be present within a selected material for a variety of average grain sizes, e.g. a range of grain sizes between 0.1-50 microns (μm). In the alternative, a textured microstructure is shown at reference numeral 20 in FIG. 3. As shown in the figure, elongated grains are present and can be produced using specific rolling strategies of a selected material and have a range of sizes and/or aspect ratios.

Figure 4B:
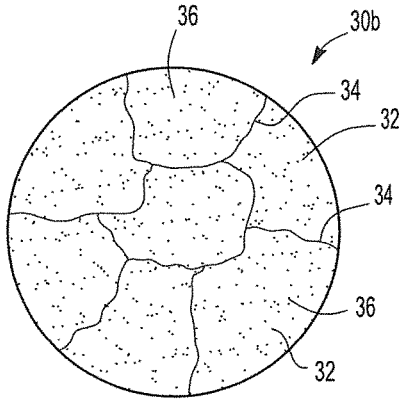
FIG. 4*b* is a schematic illustration of a microstructure for a selected material with equiax grains and having a uniform distribution of second phase precipitates.

FIG. 4*a* provides an equiax grain microstructure 30*a* with a plurality of grains 32 and grain boundaries 34 there between. It is appreciated from FIG. 4*a* that no second phase precipitates are present within the grains 32 or at the grain boundaries 34. In the alternative, FIG. 4*b* provides a microstructure 30*b* that has the plurality of grains 32, grain boundaries 34, and the addition of second phase precipitates 36 within the grains 32. The second phase precipitates 36 can have a shape such as spherical, cuboidal, and the like.

Figure 4C:
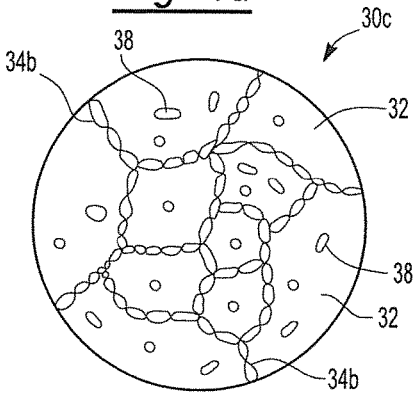
FIG. 4*c* is a schematic illustration of a microstructure for a selected material having second phase precipitates within equiax grains and precipitates along grain boundaries.
Figure 4D:
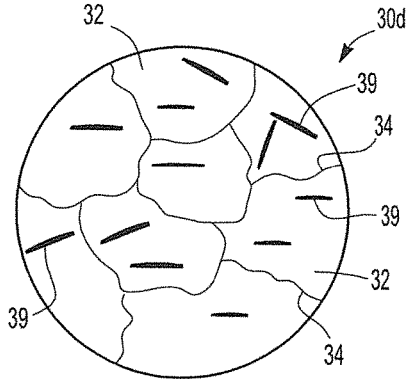
FIG. 4*d* is a schematic illustration of a microstructure for a selected material having equiax grains and acicular-shaped second phase precipitates.

FIG. 4*c* shows a microstructure 30*c* in which the grains 32 have second phase precipitates 38 therewithin and second phase precipitates 34*b* at the grain boundaries. The second phase precipitates 38 can be of a cylindrical shape, ellipsoid shape, and the like and the precipitates 34*b* at the grain boundaries may or may not be the same type of precipitate as the precipitates 38. Finally, FIG. 4*d* shows a microstructure 30*d* in which the grains 32 have acicular or needle-shaped second phase precipitates 39 therewithin. It is appreciated by those skilled in the art that the formation, shape, number density, and the like of such second phase precipitates can be controlled through alloying additions, thermo-mechanical processing of a given alloy, the application of a coating on a material, and the like.

Figure 5:
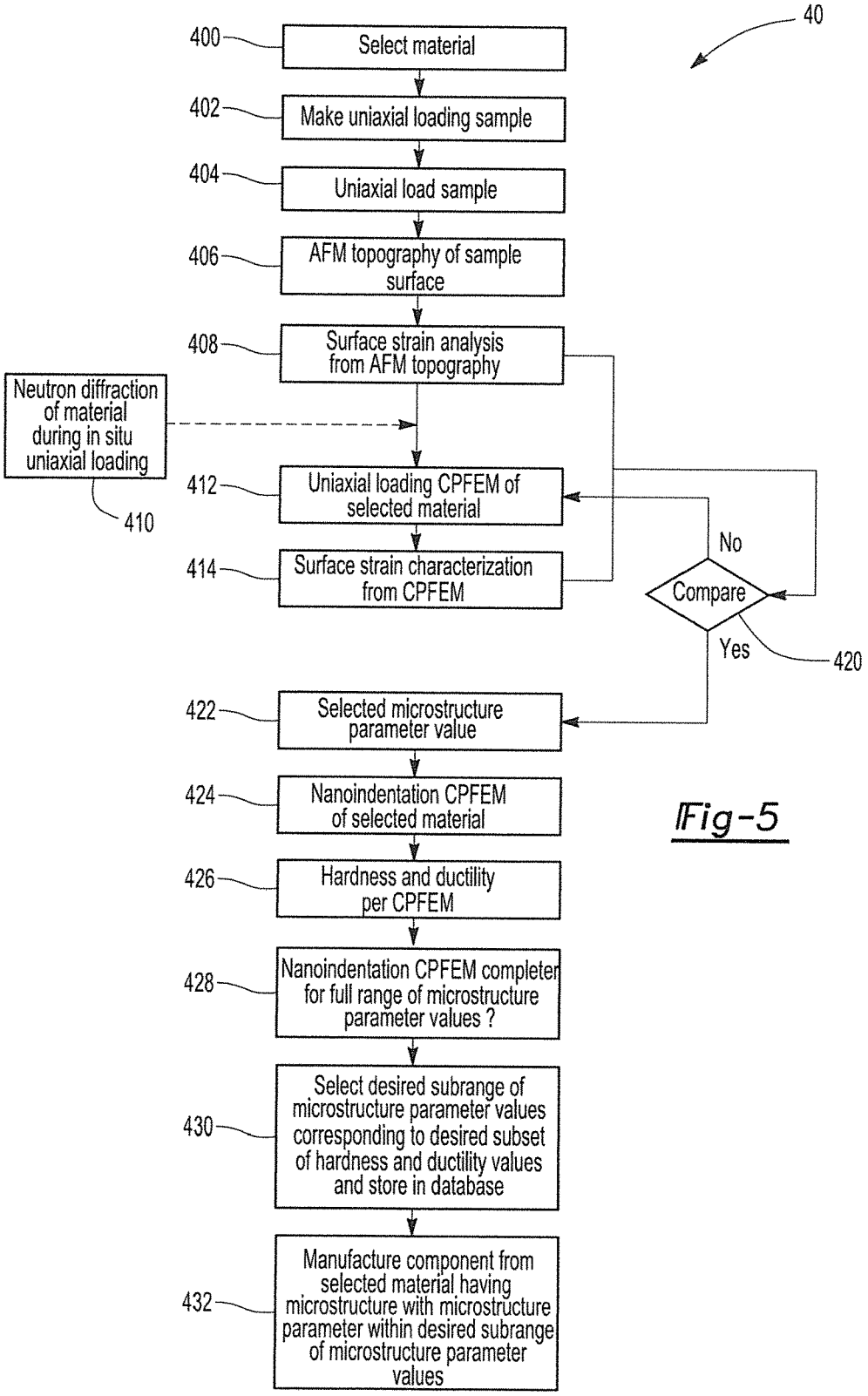
FIG. 5 is a flowchart for a process according to an embodiment of the present invention.

Turning now to FIG. 5, a process according to one or more embodiments disclosed herein is shown generally at reference numeral 40. The process 40 includes selecting a material at step 400. The material is typically selected for a given industrial application where a liquid environment is present and CE is known to be a possible wear mechanism of the material. The material is typically a metallic material such as a steel alloy, a stainless steel alloy, a nickel alloy, a cobalt alloy, a titanium alloy, an aluminum alloy, a magnesium alloy, a copper alloy, and the like.

Figure 6:
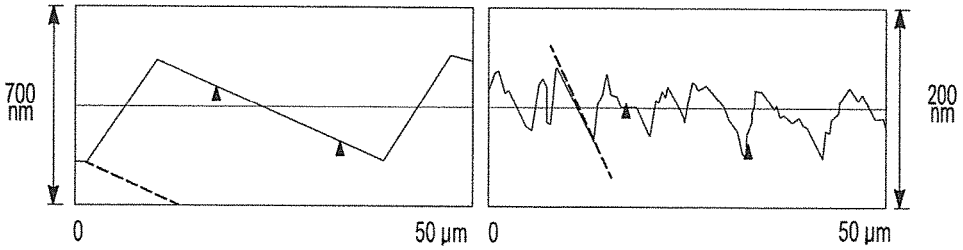
FIG. 6 is a schematic illustration of a surface for a uniaxial loaded test sample analyzed with atomic force microscopy (AFM) topography for the purpose of obtaining a surface strain analysis of the tested sample.
Figure 7:
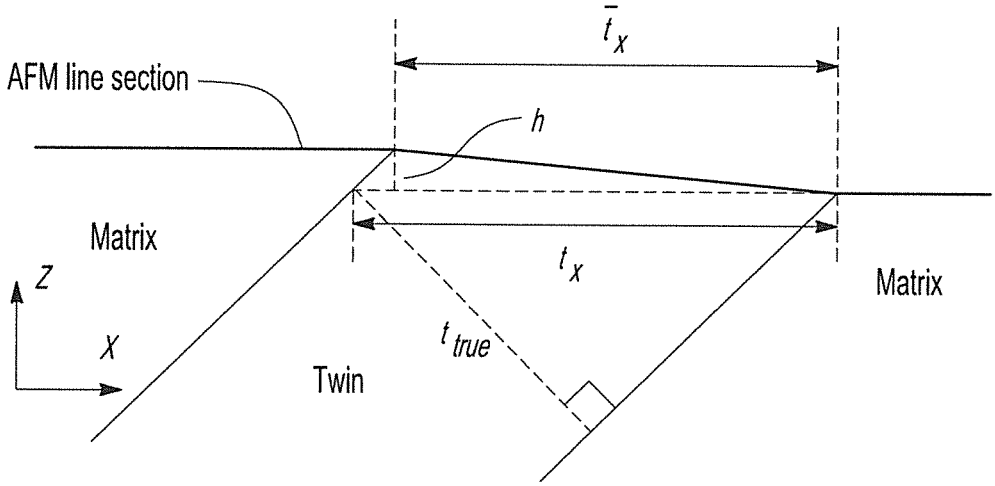
FIG. 7 is a schematic illustration of the shear strain on a sample surface.

A uniaxial loading sample, e.g. a tensile sample, is made from the selected material at step 402. The sample is subjected to uniaxial loading at step 404, for example subjecting the sample to a strain of between 1% and 10%. In some instances, the sample is subjected to approximately 3% strain. In addition, the sample surface may or may not be polished down to a very high surface resolution or smoothness (e.g. down to 50 nm) and then chemically etched in order to view the sample surface microstructure before loading. After the sample has been subjected to uniaxial loading, an atomic force microscopy (AFM) topography of the sample surface is conducted at step 406 and a surface strain analysis using the AFM topography results is conducted at step 408. For example, FIG. 6 provides an example of a section analysis of a surface topography measured by AFM along a grain on a surface of the sample. Also, FIG. 7 provides a schematic diagram of a cross section through a twinned portion of such a grain with a surface displacement 'h' due to twinning and determined or measured from an AFM line section topography in the 'x' direction. The $t_x$ and $t_{true}$ are the twin width in the x direction, i.e. the projected twin width, and the twin thickness along the twin plane normal direction, respectively. From the schematic shown in FIG. 7, the number of displaced twin planes 'N' is obtained from the measured surface step 'h' and the twin Burgers vector 'b' projected onto a normal to the surface $e_z$ per the relationship:

$$N = \frac{h}{b \cdot e_z} \tag{1}$$

The number of displaced twin planes N can be compared to an alternative derivation based on the projected twin thickness $t_x$, the twin plane normal n, and the interplane spacing d per the relationship:

$$N = \frac{t_x \cdot n}{d} \approx \frac{\tilde{t}_x \cdot n}{d} \tag{2}$$

It is appreciated that the true projected twin thickness $t_x$ is approximately equal to the apparent, i.e. measured, projected twin thickness $t_x$, if $h \ll t_x$. Thus using AFM section topography data, two alternatively derived values of N can be determined and the difference between the two obtained. For example, the difference between the two differently derived number of displaced twin planes N can be within 10%, preferably within 5%, and more preferably within 2%. As such, the AFM measurement process is robust and can be used to calculate the number of slip dislocations responsible for a series of parallel slip bands present in a grain for a sample that has been subjected to the uniaxial loading at step 404.

Figure 8:
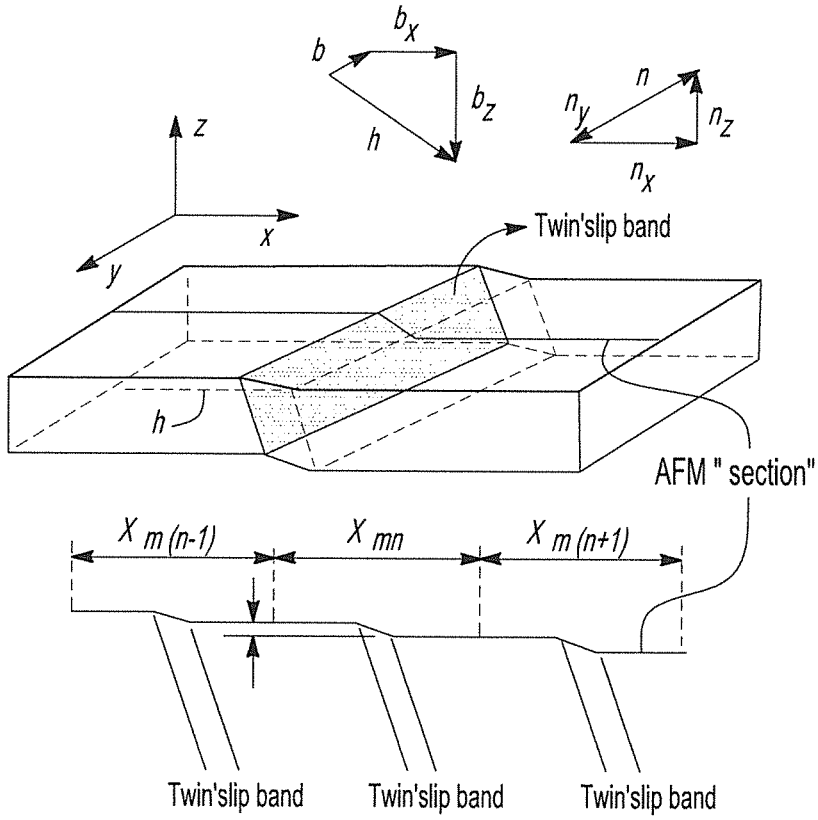
FIG. 8 is a model construction of a tensile loading sample simulated by CPFEM.

The AFM topography can also be used for calculating shear for a given deformation system using individual surface steps along a given AFM section line as illustratively shown in FIG. 8. By identifying a given deformation system (e.g. $\alpha$) related to each surface step along a given AFM section line of a given length (e.g. $X_{mn}$), and cumulating the overall height change per deformation system, the number of individual displacements occurring along the section line $X_{mn}$ can be calculated according to the above Equation 1. Furthermore, and provided that the overall surface height change across $X_{mn}$ is small compared to the length $X_{mn}$, the average shear ($\gamma$) per deformation system is provided by the relation:

$$\gamma^{\alpha} = \frac{(b^{\alpha}N^{\alpha})}{(X_{mn}\cdot n^{\alpha})} = \frac{\left(b^{\alpha}\frac{h^{\alpha}}{b^{\alpha}\cdot e_z}\right)}{(X_{mn}\cdot n^{\alpha})} \tag{3}$$

It is appreciated that the surface height changes caused by deformation systems in a given microstructure area can be scanned or determined by the AFM topography as illustrated in FIG. 6. The line section analysis can also be carried out on an entire surface area to be examined, which in turn can be divided equally into a given number of subareas. For example, each subarea can have a predefined dimension, e.g. 2.5 μm×2.5 μm. As such, shear strain according to the above relations can be calculated for each subarea and then used to produce a strain map of the entire area. Such a shear strain map can be compared to CPFEM results as discussed below.

In some instances, and although not required, neutron diffraction can be executed during the in situ uniaxial loading of the test sample at step 410. In the alternative, a separate uniaxial loading run or test can be conducted in which neutron diffraction on the sample is executed. In such instances when the neutron diffraction is conducted, single crystal stiffness data can be derived from the neutron diffraction results as is known to those skilled in the art.

Figure 9:
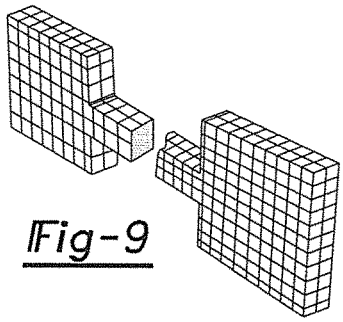
FIG. 9 is a schematic illustration of a finite element modeling (FEM) sample subjected to or to be subjected to uniaxial loading CPFEM.

At step 412, CPFEM of uniaxial loading of the selected material is conducted with an illustrative example of a finite element modeling (FEM) sample for the uniaxial loading simulations shown in FIG. 9. The CPFEM is utilized to simulate the elastic-plastic response of (hkl) lattice strains as a function of stress. It is appreciated that the terminology or nomenclature (hkl) refers to the Miller Indices for the crystal structure of the selected material as is known to those skilled in the art. The CPFEM predicts the evolution of intergranular strain caused by the orientation-dependent yield sequence and the geometric incompatibility of grain boundaries. The CPFEM also predicts the interphase strain caused by different critical resolve shear stresses at individual phases. The plastic strain rate is determined from a summation of slip rates over all slip systems which are properly weighted by the tensor products of their respective slip directions and slip plane normals. For a given slip system, the slip rate relates to the resolved shear stress by a postulated flow rule, e.g. the power law form and the classic Peirce-Asaro-Needleman model. Finally, the slip strength is governed by a hardening equation which may or may not depend on the slip strains for all the slip systems.

A surface strain characterization from the CPFEM of uniaxial loading for the selected material is conducted at step 414. Then, the results of the surface strain characterization at step 414 are compared with the surface strain analysis from AFM topography at step 408 at step 420. In the event that the comparison does not fall within a predetermined tolerance, the process returns to step 412 in which CPFEM uniaxial loading is executed with updated or revised model parameters. Such model parameters can include simulation parameters such as boundary conditions, mesh size, etc. and/or CPFEM parameters such as elastic stiffness, hardening parameters, slip strength and/or stress exponent. This cycle is completed until the surface strain characterization from the CPFEM at step 414 agrees with the surface strain analysis from AFM topography conducted at step 408 within the predetermined tolerance, at which time the process proceeds to step 427.

At step 422, a microstructure parameter value is selected and CPFEM of nanoindentation of the selected material having the selected microstructure parameter value is conducted at step 424. Step 424 can simulate nanoindentation in order to obtain mechanical property data such as hardness, elastic modulus, ductility and the like for the selected material having a given microstructure using indentation load-displacement data obtained during one cycle of loading and unloading.

Figure 10A:
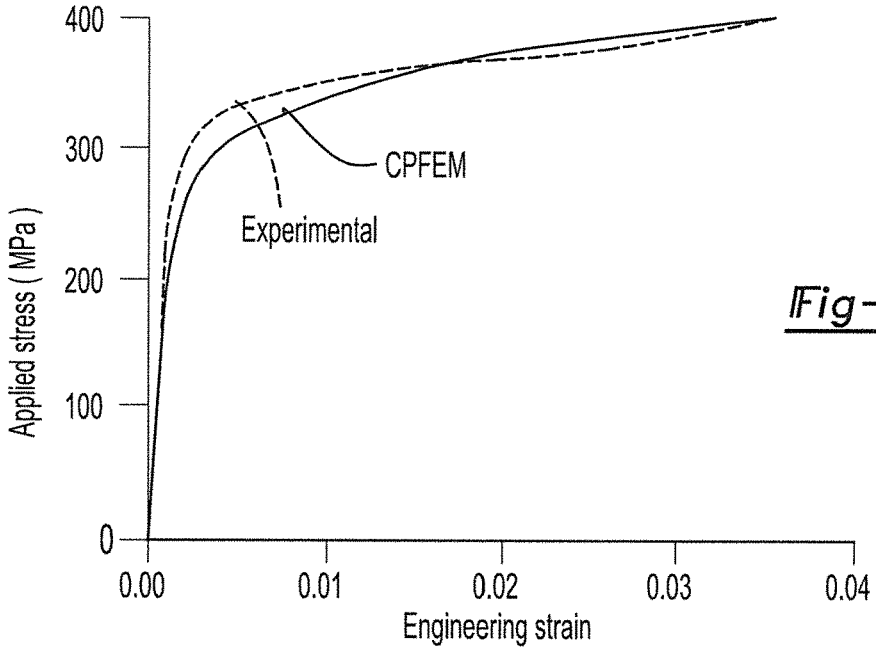
FIG. 10*a* is a graphical plot of applied stress versus engineering strain obtained for uniaxial loading of a sample by experiment and CPFEM.
Figure 10B:
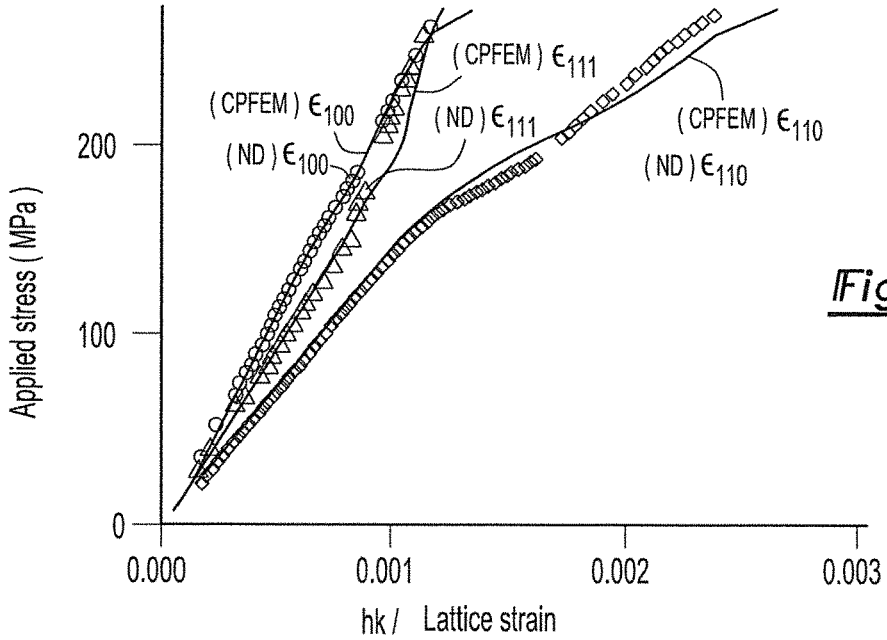
FIG. 10*b* is a graphical plot of applied stress versus hkl lattice strain obtained experimentally and by CPFEM.

A schematic representation of a typical load versus displacement curve obtained during the CPFEM simulation is shown in FIG. 10 where the parameter 'P' designates the load and 'h' the displacement relative to the initial undeformed surface. The deformation during loading is assumed to be both elastic and plastic as the hardness impression is formed. During unloading, it is assumed that only the elastic displacement is recovered and it is the elastic nature of the unloading curve that facilitates the CPFEM nanoindentation analysis. As such, it is appreciated that the CPFEM nanoindentation does not apply to materials in which plasticity reverses during unloading.

As shown in FIG. 11, the maximum load $P_{max}$, the maximum displacement $h_{max}$, and the elastic unloading stiffness S=dP/dh which is defined as the slope of the upper portion of the unloading curve during the initial stages of unloading, are provided by the graph. Another important quantity is the final depth hi which is the permanent depth of penetration after an indenter is modeled to be fully unloaded and elastic deformation of the material recovered.

The procedure used to measure the hardness H and elastic modulus E is based on the unloading process shown schematically in FIG. 12. The quantity or variable $h_s$ is given by the relation:

$$h_s = \varepsilon\frac{P_{max}}{S} \tag{4}$$

where $\varepsilon$ is a constant that depends on the geometry of the indenter, e.g. $\varepsilon$=0.72 for a conical punch, $\varepsilon$=0.75 for a paraboloid of revolution which approximates a sphere at small depths, and $\varepsilon$=1.00 for a flat punch.

Using the relation above to approximate the vertical displacement of the contact periphery, it follows from the geometry shown in FIG. 12 that the depth along which contact is made between an indenter and a specimen, $h_c=h_{max}-h_s$ is equal to:

$$h_c = h_{max} - \varepsilon\frac{P_{max}}{S} \tag{5}$$

Letting F(d) be an "area function" that describes the projected or cross-sectional area of the indenter at a distance d back from its tip, the contact area is provided by the relation:

$$A=F(h_c) \tag{6}$$

The area function is also known as the indenter shape function and must be carefully calibrated by independent measurements so that deviations from non-ideal indenter geometry are taken into account.

Once the contact area is determined, the hardness is estimated from the relation:

$$H = \frac{P_{max}}{A} \tag{7}$$

The elastic modulus follows from its relationship to contact area and the measured unloading stiffness (S) through the relation:

$$S = \beta \frac{2}{\sqrt{\pi}} E_{eff} \sqrt{A} \tag{8}$$

where $E_{eff}$ is the effective elastic modulus defined by:

$$\frac{1}{E_{eff}} = \frac{1-v^2}{E} + \frac{1-v^2}{E_i} \tag{9}$$

It is appreciated that the effective elastic modulus takes into account elastic displacements that occur in both the specimen and the indenter.

The hardness, elastic modulus, and/or ductility are obtained for the CPFEM nanoindentation for the one selected microstructure parameter value at step 426. At step 428, the process determines whether or not CPFEM of nanoindentation has been completed or simulated for a full range of microstructure parameter values. Once CPFEM nanoindentation has been completed for a full range of selected microstructure parameter values, the process proceeds to step 430 in which a desired subrange of microstructure parameter values corresponding to a desired subset of hardness, elasticity, and/or ductility values is selected and stored in a database. Finally, a component is manufactured from the selected material at step 432, with the component having a microstructure with a microstructure parameter that is within the desired subrange of microstructure parameter values selected in step 430.

In some instances, the CPFEM nanoindentation is performed for more than one type of microstructure parameter value. For example, the CPFEM nanoindentation simulations can be conducted for a range of average grain sizes for the selected material, a range of average grain orientation distributions, whether or not one or more types of second phase precipitates are present within the microstructure, the type of second phase precipitates that may be present, an average size distribution of second phase precipitates that may be present, an average shape distribution of second phase precipitates, an average particle number density of the second phase precipitates, and the like. It is appreciated that such simulations of CPFEM nanoindentation for a range of various microstructure parameters can limit or possibly eliminate the need for experimental testing of a selected material with different microstructures. Stated differently, the process disclosed herein greatly improves the design and manufacture of components used in cavitation erosion susceptible environments.

In order to better illustrate the teachings of the instant disclosure and yet not limit its scope in any manner, one or more examples of the process disclosed herein are provided below.

A 316 stainless steel alloy was selected for testing and modeling. The initial microstructure of a cold rolled sheet of the 316 alloy was obtained by electron backscattering diffraction (EBSD) inverse polling. The average grain size of the cold rolled sheet was approximately 10 microns and an interested area for testing within a gauge center of a tensile sample was set out or identified using four micro indentation marks. Uniaxial loading to an extent of approximately 3% total strain was performed on the sample and using a microscope with a magnification of 2000×, slip bands were clearly revealed and observed.

An AFM surface topography and line section analysis was conducted and the surface height change was obtained from the profile shown in FIG. 6. The surface height change due to the crystalline slip was within 10 microns. The number of dislocation slips N was determined using expressions (1) above which was also used to check the accuracy of the AFM topography analysis. In addition, the shear strain on the sample surface was determined using the process described above with reference to FIGS. 7 and 8.

The 316 alloy is known to have a face centered cubic (FCC) crystal structure with 12 slip systems in the <110>{111} slip family. The lattice parameter for the 316 alloy is a=0.365 nanometers and the Burgers vector $$b = \frac{a}{2}\sqrt{h^2+k^2+l^2} = 0.258 \text{ nanometers.}$$

By identifying the system related to each surface step along an AFM section line of length $X_{mn}$ and accumulating the overall height change per system, the number of individual displacements occurring along the line $X_{mn}$ was calculated according to the relationship (1). As noted above, the line section analysis was carried out on the whole surface area which was divided equally into 100 subareas with each of the subareas dimensioned to be 2.5 μm×2.5 μm. The shear strain according to Equation (3) was calculated for each subarea and then used to form a strain map of the entire area.

CPFEM uniaxial loading of the 316 alloy was also conducted using the FEM sample illustrated in FIG. 9 and maps of shear strain and stress along the loading direction for the CPFEM simulation were obtained. The FEM sample shown in FIG. 9 was modeled as a system of polycrystalline aggregate containing approximately 500 cubic grains with a random texture in the center gauge section and 2×2×2 grids, or equivalently 8 elements, in each grain. The elements inside each grain were assumed to have a crystallographic orientation which mimicked a cube-on-cube orientation of grains in a real alloy system. The region on two sides of the gauge section was controlled by a Von Mises plasticity law to save on computational cost.

The calculated (hkl) lattice strain was a volume average of projected elastic strains in a subset of grains whose (hkl) plane normal was parallel to a diffraction vector Q. To improve the statistics of the CPFEM uniaxial loading simulation, grain orientations were assigned a difference of within 5 degrees relative to each <hkl> direction to ensure that between 1 and 2 percent of the total 500 grains could be selected for each <hkl> direction. The input material parameters for the CPFEM included stiffness values for $C_{11}$, $C_{12}$, and $C_{44}$, which were the single crystal elastic constants for cubic materials. In addition, the stress exponent 'n', the initial hardening modulus $h_0$, the initial slip strength $\tau_0$, the saturation slip strength $\tau_s$, and the latent hardening parameter q were also provided.

It is appreciated that the slip strength $\tau_0$ is related to the macroscopic yield strength of a polycrystal by a Taylor factor, which is about 3 for an FCC material. The CPFEM uniaxial loading predicted a critical resolved shear stress of approximately 150 megapascals (MPa) at room temperature. The simulation also demonstrated that latent hardening behavior played an important role in the evolution of intergranular strains. However, and given that no significant hardening is known to occur for the 316 alloy, the other plastic parameters were chosen to fit the experimental data shown in FIGS. 12*a* and 12*b*. The group of plasticity parameters are provided in Table 1 below.

TABLE 1

| $c_{11}$ (GPa) | $c_{12}$ (GPa) | $C_{44}$ (GPa) | $\tau_0$ (MPa) | $\tau_s$ (MPa) | n | $h_0$ | q |
|---|---|---|---|---|---|---|---|
| 204.8 | 136.6 | 126.4 | 94 | 147 | 50 | 220 | 1.0 |

To capture the surface deformation behavior for SUS316 after tensile loading and compare with the surface strain calculated from the AFM-based method, another tensile model with a quasi-3D mesh based on the microstructure obtained from the EBSD measurements was used. The mesh was developed by distributing nodes along straight grain boundary traces, planar surface meshing of enclosed grains, and expansion by 10 microns into the third dimension. This third dimension was evenly divided into 10 elements. As such, all grain boundaries were perpendicular to the surface in the approximation/simulation.

To replicate the constraint in the bulk material, the simulated microstructure was placed in a rectangular pen-like container. The container was simulated using the Von Mises plasticity model in order to increase computation efficiency as noted above. Crystallographic orientations were assigned to the simulated microstructure patch according to the EBSD measurements through specifying local material coordinates. Tensile loading was applied on one side of the microstructure patch.

The cumulative shear strains $\Sigma_\alpha \gamma^\alpha$ over all the slip systems calculated by the CPFEM simulations and the AFM topography analysis are compared in FIGS. 13*a* and 13*b*. The highlighted section labeled 0.28 in FIG. 13*a*, and 0.33 and 0.28 in FIG. 13*b*, show areas of severe strain concentration and also show that the CPFEM simulation agrees with experimental results. In FIG. 13*b*, strain distribution was not mapped within grains where slip traces were not clearly observed after deformation by AFM. When reaching the microstructure patch boundary, the boundary effect from the bulk material in the simulation may cause poor agreement between these two methods.

After the comparison showed the agreement between simulation and experiments, CPFEM nanoindentation of the selected material was executed for a range of microstructures. The CPFEM nanoindentation simulations provided a plurality of hardness, elasticity, and/or ductility values as a function of different microstructure parameters and parameter values which then allowed for a selection of a desired subset of hardness, elasticity, and ductility values known to provide increased cavitation erosion resistance. Along with the selection of the subset of hardness, elasticity, and/or ductility values, the corresponding subrange of microstructure parameter values was also selected. Stated differently, a unique set or subrange of microstructure parameters for the 316 alloy was determined. It is appreciated that the component would have an increased CE resistance compared to a component made from the 316 alloy having a microstructure that falls outside the subrange of microstructure parameters determined by the CPFEM nanoindentation simulations.

With respect to the simulations, the CPFEM was performed on a computer as illustrated in FIG. 14. The schematic illustration of the computer is shown generally at reference numeral 50, the computer 50 having a processing unit 500. The processing unit 500 can include memory 502, a software module 504, permanent memory 506, and RAM memory 508. It is appreciated that the computer 50 can perform the CPFEM simulations and display graphical representations thereof disclosed herein.

It is appreciated that the above described embodiments and examples are for illustrative purposes only and do not limit the scope of the invention in any way. Changes, modifications, and the like will be apparent to those skilled in the art and yet fall within the scope of the invention. As such, it is the claims and all equivalents thereof that define the scope of the invention.

We claim:

1. A process for designing and manufacturing a cavitation erosion resistant component for use in a cavitation erosion susceptible environment, the process comprising:

selecting a material for the cavitation erosion resistant component;

conducting a uniaxial loading test on a sample of the selected material;

conducting atomic force microscopy (AFM) topography on a surface of the tested sample;

conducting a surface strain analysis of the surface of the tested sample using results from the AFM topography;

performing crystal plasticity finite element modeling (CPFEM) of uniaxial loading of the selected material and obtaining a surface strain characterization from the uniaxial loading CPFEM;

comparing the AFM topography surface strain analysis and the CPFEM surface strain characterization and determining if the comparison falls within a predetermined tolerance of less than or equal to 10 percent;

when the comparison falls within the predetermined tolerance, conducting CPFEM nanoindentation on a FEM model of the selected material over of a range of values of one or more microstructure parameters for the selected material, the CPFEM nanoindentation of the selected material producing a plurality of hardness and ductility values as a function of the range of values of the one or more microstructure parameters;

selecting a subset of the plurality of hardness and ductility values and a corresponding subrange of the values of the one or more microstructure parameters that produced the subset of plurality of hardness and ductility values; and manufacturing a component from the selected material, the component having a microstructure with values of the one or more microstructure parameters within the corresponding subrange of the values of the one or more microstructure parameters and hardness and ductility values within the selected subset of the plurality of hardness and ductility values, the manufactured component having improved cavitation erosion resistance compared to another component made from the selected material and having a microstructure with values of the one or more microstructure parameters outside the corresponding subrange of the values of the one or more microstructure parameters and hardness and ductility values outside the selected subset of the plurality of hardness and ductility values.

2. The process of claim 1, wherein the manufactured component is a component of a high pressure pump.

3. The process of claim 2, wherein the uniaxial loading CPFEM simulates a tensile sample of the selected material with a plurality of grains and uses single crystal lattice parameters for each of the plurality of grains.

4. The process of claim 3, wherein the one or more microstructure parameters include at least one of: grain size distribution, grain orientation distribution, presence of second phase precipitates, type of second phase precipitates, size distribution of second phase precipitates, and shape distribution of second phase precipitates.

5. The process of claim 4, further comprising:

conducting neutron diffraction, after the uniaxial loading test, on the sample of the selected material and obtaining single crystal stiffness data on the selected material.

6. The process of claim 5, wherein the CPFEM of uniaxial loading uses the single crystal stiffness data.

7. A process for designing and manufacturing a cavitation erosion resistant component for use in a cavitation erosion susceptible environment, the process comprising:

determining a liquid environment used in a given industrial application as the cavitation erosion susceptible environment;

selecting a material for the cavitation erosion resistant component to be used in the liquid environment;

providing a tensile test sample made from the selected material;

conducting a uniaxial loading tensile test on the tensile test sample;

conducting an atomic force microscopy (AFM) topography on a surface of the tensile test sample and determining a surface strain of the tensile test sample from the AFM topography;

creating a computer model of the tensile test sample of the selected material;

performing crystal plasticity finite element modeling (CPFEM) of uniaxial loading on the computer model tensile test sample and determining a CPFEM surface strain;

comparing the surface strain of the tensile test sample to the CPFEM surface strain of the computer model tensile test sample;

when the comparison falls within a predetermined tolerance of less than or equal to 10 percent, conducting CPFEM nanoindentation on a FEM model of a nanoindentation sample of the selected material over of a range of values for one or more microstructure parameters, the nanoindentation CPFEM providing a plurality of hardness and ductility values as a function of the range of values for the one or more microstructure parameters;

selecting a subrange of values for the one or more microstructure parameters that correspond to a subset of the plurality of hardness and ductility values, the subset of the plurality of hardness and ductility values corresponding to improved cavitation erosion resistance; and manufacturing a component from the selected material with a microstructure having one or more values of the one or more microstructure parameters within the subrange of values for the one or more microstructure parameters, the manufactured component having improved cavitation erosion resistance compared to another component made from the selected material that has a microstructure with one or more values for the one or more microstructure parameters outside the selected subrange of the values for the one or more microstructure parameters.

8. The process of claim 7, wherein the one or more microstructure parameters includes at least one of: average grain size, average grain orientation, presence of second phase precipitates, type of second phase precipitates, average size of second phase precipitates, average shape of second phase precipitates and average particle number density of second phase precipitates.

9. The process of claim 8, further comprising:

conducting neutron diffraction, after the uniaxial loading tensile test, on the tensile test sample and obtaining single crystal stiffness data on the selected material.

10. The process of claim 9, wherein the CPFEM of uniaxial loading uses the crystal stiffness data.

11. The process of claim 10, wherein the one or more microstructure parameters includes average grain size for the selected material and the range of values for the one or more microstructure parameters includes a range of average grain sizes for the selected material.

12. The process of claim 8, wherein the one or more microstructure parameters includes at least two of: average grain size, average grain orientation, presence of second phase precipitates, type of second phase precipitates, average size of second phase precipitates, average shape of second phase precipitates and average particle number density of second phase precipitates.

13. The process of claim 12, wherein the at least two microstructure parameters are the average grain size and the average particle number density of second phase precipitates for the selected material.

14. The process of claim 13, wherein the range of values for the at least two microstructure parameters are a range of average grain sizes for the selected material and a range of average particle number density of second phase precipitates for the selected material.

15. The process of claim 7, wherein the given industrial application is a high pressure pump.

16. The process of claim 7, wherein the uniaxial loading CPFEM simulates a tensile sample with a plurality of grains and uses single crystal lattice parameters for each of the plurality of grains.

17. A process for designing and manufacturing a cavitation erosion resistant component for use in a cavitation erosion susceptible environment, the process comprising:

selecting a material for the cavitation erosion resistant component;

conducting a uniaxial loading test on a sample of the selected material;

conducting atomic force microscopy (AFM) topography on a surface of the tested sample;

conducting a surface strain analysis of the surface of the tested sample using results from the AFM topography;

conducting neutron diffraction during in situ uniaxial loading of a sample of the selected material and obtaining single crystal stiffness data on the selected material;

performing crystal plasticity finite element modeling (CPFEM) of uniaxial loading of a finite element model of the selected material using the obtained single crystal stiffness data and obtaining a surface strain characterization from the uniaxial loading CPFEM;

comparing the AFM topography surface strain analysis and the CPFEM surface strain characterization and determining if the comparison falls within a predetermined tolerance of less than or equal to 10 percent;

when the comparison falls within the predetermined tolerance, conducting CPFEM nanoindentation on a FEM model of the selected material over an iteration of average grain sizes for the selected material, the CPFEM nanoindentation of the selected material providing a plurality of hardness and ductility values as a function of average grain size;

selecting a subset of the plurality of hardness and ductility values and corresponding average grain sizes that produced the subset of plurality of hardness and ductility values; and manufacturing a component from the selected material, the component having a microstructure with an average grain size within the corresponding average grain sizes, the manufactured component having improved cavitation erosion resistance compared to another component made from the selected material and having a microstructure with an average grain size outside the corresponding average grain sizes.

18. The process of claim 17, further comprising:

conducting CPFEM nanoindentation of the selected material over of an iteration of average particle number density for second phase precipitates for the selected material, the CPFEM nanoindentation of the selected material providing a plurality of hardness and ductility values as a function of the average grain size and average particle number density for second phases precipitates;

selecting a subset of the plurality of hardness and ductility values and corresponding average grain sizes and average particle number densities for second phases precipitates that produced the subset of plurality of hardness and ductility values; and wherein the component has the microstructure with an average grain size and an average particle number density for second phases precipitates within the corresponding average grain sizes and average particle number densities for second phases precipitates, the manufactured component having improved cavitation erosion resistance compared to another component made from the selected material and having a microstructure with an average grain size outside the corresponding average grain sizes and an average particle number density for second phases precipitates outside the corresponding average particle number density for second phases precipitates.

19. The process of claim 18, further comprising:

conducting CPFEM nanoindentation of the selected material over of an iteration of average shape of second phase precipitates for the selected material, the CPFEM nanoindentation of the selected material providing a plurality of hardness and ductility values as a function of the average grain size, average particle number density for second phases precipitates and average shape of second phase precipitates; and selecting a subset of the plurality of hardness and ductility values and corresponding average grain sizes, average particle number densities for second phases precipitates and average shapes of second phase precipitates that produced the subset of plurality of hardness and ductility values, wherein the manufactured component has the microstructure with an average grain size, an average particle number density for second phases precipitates and an average shape of second phase precipitates within the corresponding average grain sizes, average particle number densities for second phases precipitates and average shapes of second phase precipitates, respectively, the manufactured component having improved cavitation erosion resistance compared to another component made from the selected material and having a microstructure with an average grain size outside the corresponding average grain sizes, an average particle number density for second phases precipitates outside the corresponding average particle number densities for second phases precipitates and an average shape of second phase precipitates outside the corresponding average shape of second phase precipitates.

20. The process of claim 19, wherein the iteration of average shapes of second phases of second phases precipitates includes two or more of:

spherical, cylinder, ellipsoid, cuboid and needle-shaped acicular.

* * * * *